US007857279B2

(12) United States Patent
Krasnicki

(10) Patent No.: US 7,857,279 B2
(45) Date of Patent: Dec. 28, 2010

(54) BOW HOLDER AND BOW CRADLE

(76) Inventor: David A. Krasnicki, 14960 Belle River Rd., Allenton, MI (US) 48002

( * ) Notice: Subject to any disclaimer, the term of this patent is extended or adjusted under 35 U.S.C. 154(b) by 421 days.

(21) Appl. No.: 11/308,295

(22) Filed: Mar. 15, 2006

(65) Prior Publication Data

US 2007/0215763 A1 Sep. 20, 2007

(51) Int. Cl.
*F16M 13/00* (2006.01)

(52) U.S. Cl. ..... 248/545; 248/122.1; 248/125.1; 248/156; 124/86

(58) Field of Classification Search ..... 124/86, 124/88, 89; 248/156, 545, 121, 125.2, 122.1, 248/159, 530; 42/94
See application file for complete search history.

(56) References Cited

U.S. PATENT DOCUMENTS

| | | | | | |
|---|---|---|---|---|---|
| 2,275,870 | A | * | 3/1942 | Sheldon | 211/85.7 |
| 3,225,656 | A | * | 12/1965 | Flaherty et al. | 89/37.04 |
| 3,584,820 | A | * | 6/1971 | Butcher, Sr. | 248/122.1 |
| 3,952,878 | A | * | 4/1976 | Gorham | 211/64 |
| 4,089,423 | A | * | 5/1978 | Gorham et al. | 211/64 |
| 4,144,971 | A | * | 3/1979 | Balibrea | 211/64 |
| 4,331,311 | A | * | 5/1982 | Russell | 248/176.1 |
| 4,377,270 | A | * | 3/1983 | Kolongowski | 248/441.1 |
| 4,854,066 | A | * | 8/1989 | Canterbury, Sr. | 42/94 |
| 4,896,854 | A | * | 1/1990 | St. Laurent | 248/156 |
| 4,937,965 | A | * | 7/1990 | Narvaez | 42/94 |
| 5,111,800 | A | | 5/1992 | Reynolds | |
| 5,240,211 | A | * | 8/1993 | Anderson | 248/125.3 |
| 5,377,657 | A | * | 1/1995 | Foster et al. | 124/86 |
| 5,666,757 | A | * | 9/1997 | Helmstadter | 42/94 |
| 5,680,939 | A | * | 10/1997 | Oliver | 211/64 |
| 5,819,462 | A | * | 10/1998 | Dockery | 42/94 |
| 5,913,667 | A | * | 6/1999 | Smilee | 42/94 |
| 5,913,668 | A | * | 6/1999 | Messer | 42/94 |
| 6,059,240 | A | * | 5/2000 | Gorsuch | 248/219.4 |
| 6,199,734 | B1 | | 3/2001 | Meeks | |
| 6,244,556 | B1 | * | 6/2001 | Carrillo et al. | 248/519 |
| 6,637,708 | B1 | * | 10/2003 | Peterson | 248/285.1 |
| 6,663,059 | B1 | * | 12/2003 | Warren | 248/156 |
| 6,726,160 | B1 | * | 4/2004 | Buchanan, Jr. | 248/156 |
| 6,732,985 | B1 | * | 5/2004 | Cantrell | 248/125.1 |
| 6,749,170 | B1 | * | 6/2004 | Rhoads | 248/545 |
| 6,948,690 | B1 | * | 9/2005 | Sandel | 248/218.4 |
| 6,948,694 | B1 | * | 9/2005 | Gilbert | 248/530 |
| 7,311,097 | B1 | * | 12/2007 | Callis | 124/23.1 |
| 2003/0213880 | A1 | * | 11/2003 | Witt et al. | 248/156 |
| 2005/0178938 | A1 | * | 8/2005 | Sutherland et al. | 248/309.1 |

* cited by examiner

*Primary Examiner*—Terrell McKinnon
*Assistant Examiner*—Bradley H Duckworth
(74) *Attorney, Agent, or Firm*—Gregory T. Zalecki

(57) ABSTRACT

An improved bow holder is comprised of a bow cradle, at least one extension member and a base. The bow cradle is comprised of a body, a guide and a limb rest. The guide receives and holds the limb of a bow and is attached to the top of the body. The limb rest is comprised of a pair of extension arms pivotally attached to the body, upright arms projecting from each extension arm and a stop. The extension arms and upright arms securely hold the lower limb and cam of a bow. The base is comprised of a stem for insertion into a ground surface and a pair of pedals for applying ground insertion force to the stem. The bow cradle is attached to the base, or if a higher bow holding position is desired, an extension member.

12 Claims, 5 Drawing Sheets

BOW HOLDER AND BOW CRADLE

BACKGROUND

Bow owners use their bows for hunting, target shooting or both. A typical compound bow is comprised of a pair of limbs, a cam at each end of each limb and a bow string connected to the cams. It is desirable to avoid laying a bow on the ground. The ground may be muddy, wet or covered with snow. If the bow is laying on the ground it can easily be contaminated by mud, water or snow. It also takes much more time to retrieve a bow laying on the ground and to shoot an arrow at a hunted animal as compared to shooting an arrow at a hunted animal while the bow is already being grasped by the hunter.

The solution of having the archer continuously holding the bow is also not desirable. After a short period of time continuously holding the bow becomes tiring and boring. Similarly, the solution of temporarily storing the bow within a storage case is not desirable. Loading and unloading the bow into the storage case is needlessly time-consuming. The case can become muddied, wet, or contaminated by snow or other debris. When the bow is stored within a storage case there will usually be insufficient time for a hunter to retrieve the bow after a hunted animal is spotted.

Archers often hunt from within trees. It is impractical to store a bow in a storage case while the archer is in a tree. Likewise, it is impractical for an archer positioned within a tree to store the bow on any part of the tree structure. Trees do not normally provide surfaces for securely retaining bows. Even if such a surface could be found within a tree, the delay caused by the procedure required to retrieve the bow and shoot an arrow while hunting would often be unacceptable.

There is a need for an improved bow holder having the following characteristics. It could be mounted on the ground or upon a tree limb. It would hold and keep a bow elevated above the ground or a tree limb upon which it is mounted. Its height would be adjustable so that an archer could use the bow holder while sitting, standing or squatting. It would be easy to store. It would be lightweight and take up minimal space. It could be quickly assembled. Optionally, it would provide a quiver for holding arrows.

SUMMARY

The improved bow holder described herein has these desirable characteristics. A key component of the improved bow holder is a bow cradle. The bow cradle may be attached to a base fixed within the ground. It may be attached to a tree mount. Or, it may be attached to one or more extension members wherein a bottom extension member is attached to a base or a tree mount. The bow cradle is comprised of a body, a guide and a limb rest.

The body has a first mating end at its lower end. The first mating end is shaped and sized to mate with a member having a second mating end. Preferably, the body is a pipe. Preferably, the first mating end of the pipe is the opening at its lower end. The first mating end fits over another structural member. The other structural member may be a pipe projecting from the base, the upper end of an extension member or a pipe projecting from a tree mount. The outside diameter portion of the other structural member in such a configuration fits into the inside diameter opening of the body. Thus the lower end of the body is preferably shaped and sized to receive and securely hold a structural member which is a part of the base, a tree mount or an extension member.

The guide is shaped and sized to receive and securely hold a limb of the bow. It may be a U-shaped bracket having an opening width slightly larger than the width of a section of the limb of the bow intended to be supported. The guide is attached to an upper aspect of the body.

The limb rest is comprised of a bed, a wall and a stop. The bed is adapted to support the limb of the bow. The bed is further adapted to be pivotally mounted to the body. Preferably, the bed is comprised of a pair of extension arms for supporting the limb of the bow. The extension arms are spaced apart such that they may simultaneously support the limb. The extension arms are adapted to be pivotally mounted to the body.

The bed is pivotally attached to the body. If the bed is a pair of extension arms, the extension arms are pivotally attached to the body.

The wall projects substantially perpendicularly from the end of the bed which is distal to the body. Preferably, the bed is comprised of an upright arm projecting substantially perpendicularly from the end of each extension arm distal to the body. The wall should be shaped and sized such that a cam of the bow may pass through a plane defined by the wall and such that the limb of the bow may not pass through the plane defined by the wall when the limb of the bow is seated upon the bed. If the wall is comprised of upright arms projecting from the extension arms, as described, the upright arms are spaced apart such that a cam of the bow may pass through a plane defined by the upright arms and such that the limb of the bow may not pass through the plane defined by the upright arms when the limb of the bow is seated upon the extension arms.

The stop is attached to a lower aspect of the bed proximal to the body. Preferably, the bed is comprised of a pair of extension arms. The stop is attached such that the angle defined by the bed, or the extension arms, and the upper aspect of the body is an acute angle when the stop contacts the body.

The bow cradle may be attached to a base, a tree mount or an extension member. The base is comprised of a stem and a pair of pedals. The lower end of the stem is pointed to facilitate insertion into a ground surface. The upper end of the stem has a second mating end. As used herein second mating ends mate with first mating ends. The second mating end of the stem is shaped and sized to mate with a member having a first mating end. Thus, if the member having a first mating end is the body of the bow cradle, the second mating end of the stem is shaped and sized to mate with the first mating end of the body. Preferably, the outside diameter portion of the second mating end of the upper end of the stem tightly fits within the inside diameter portion of the first mating end of the body. The pedals are hingedly attached to the upper end of the stem. This allows a user to apply a ground insertion force to the stem with the user's foot. The lower end of the body is attached to the upper end of the stem such that the first mating end of the body on the lower end of the body mates with the second mating end on the upper end of the stem.

The bow cradle may be mounted to a tree mount. A tree mount is comprised of a flange and a mating number. The flange is adapted to be seated upon a tree stand structure such as a tree limb. Hunters often build tree stand structures into one or more trees. As used herein the term tree stand structure includes the artificial structure built into one or more trees, as well as tree limbs adjacent to the artificial structure. The flange has a plurality of fastener openings for securing the flange upon a tree stand structure with fasteners. The fasteners may be nails or screws, as well as other types of fasteners. The mating member is perpendicularly attached to the flange. The distal end of the mating member has a second mating end which is sized and shaped to mate with a member having a first mating end. Preferably, the mating member is a pipe having an outside diameter portion which tightly and securely fits within the first mating end of a body. Because the mating member is configured to have a second mating end which is sized and shaped to mate with a member having a first mating end, the mating member may also be attached to the first mating end of an extension member. When the bow cradle is used with a tree mount the lower end of the body is attached to the distal end of the mating member such that the first mating end of the body on the lower end of the body mates with the second mating end on the distal end of the mating member.

When the bow cradle is directly attached to a base or a tree mount a relatively low bow holding position is established. The archer may desire that the bow be positioned higher from the mounting surface, whether that surface be the ground or a tree limb. Higher bow holding positions may be obtained by installing one or more extension members between the bow cradle and the base or tree mount. Each extension member has an upper end and a lower end. The upper end of each extension member has a second mating end. The second mating end is shaped and sized to mate with a member having a first mating end. The lower end of each extension member has a first mating end shaped and sized to mate with a member having a second mating end. The member may be the body of a bow cradle, another extension member or the upper end of the stem of a base. The lower end of one extension member is attached to the upper end of the stem. The lower end of the body of the bow cradle is attached to a second mating end of an extension member. If more than one extension member is used they are connected together at mating ends such that the completed extension member assembly has a second mating end at its upper end and a first mating end at its lower end.

A quiver may be attached to the extension member or extension members. Preferably, the quiver is releasably attached so that its use is optional and so that it may be easily and quickly attached and removed.

DRAWINGS

These and other features, aspects, and advantages of the present invention will become better understood with regard to the following description, appended claims, and accompanying drawings where:

DETAILED DESCRIPTION

Figure 1:
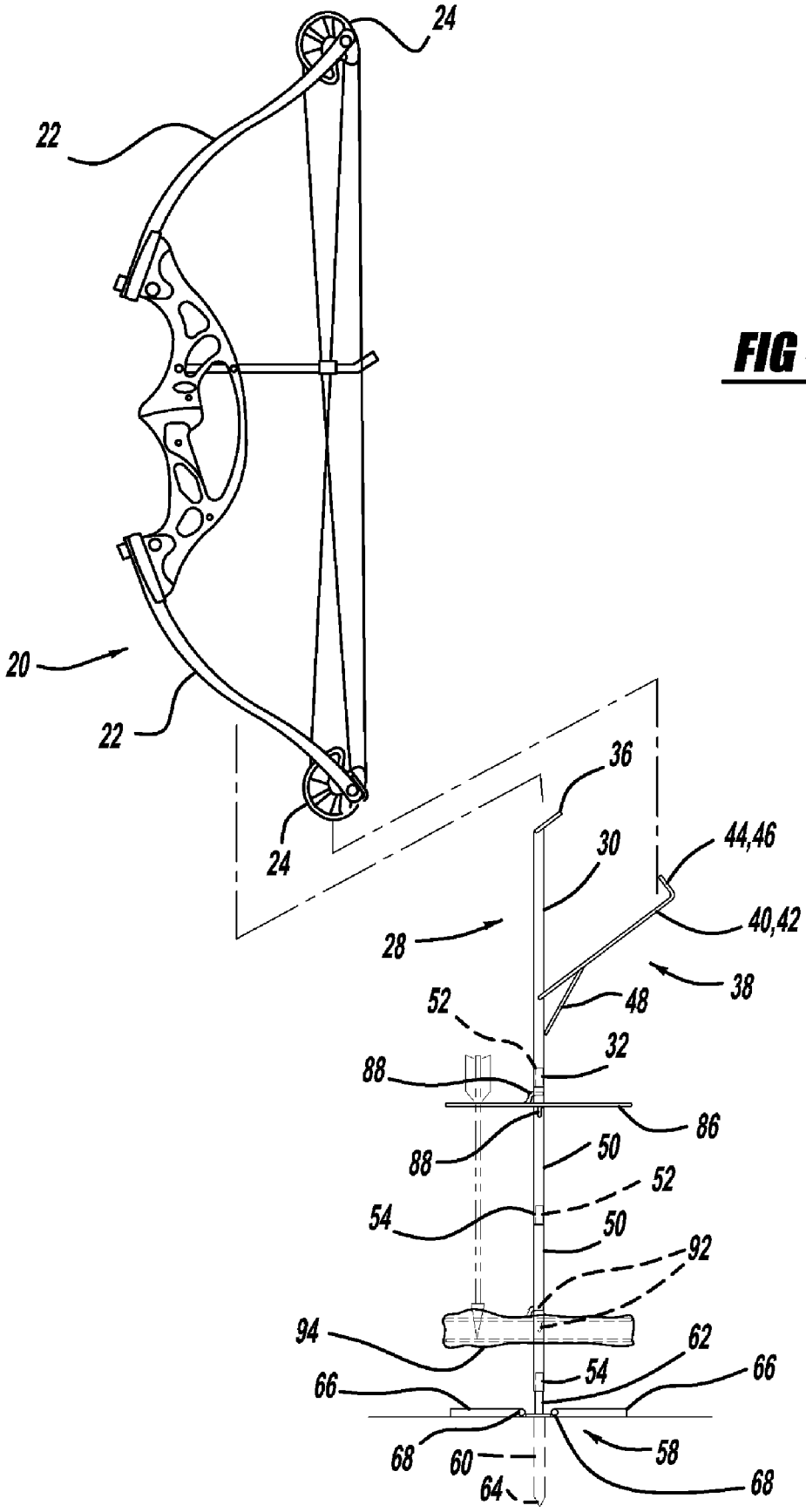
FIG. 1 is a side elevation view of an improved bow holder prior to the placement of a bow within the bow holder.
Figure 8:
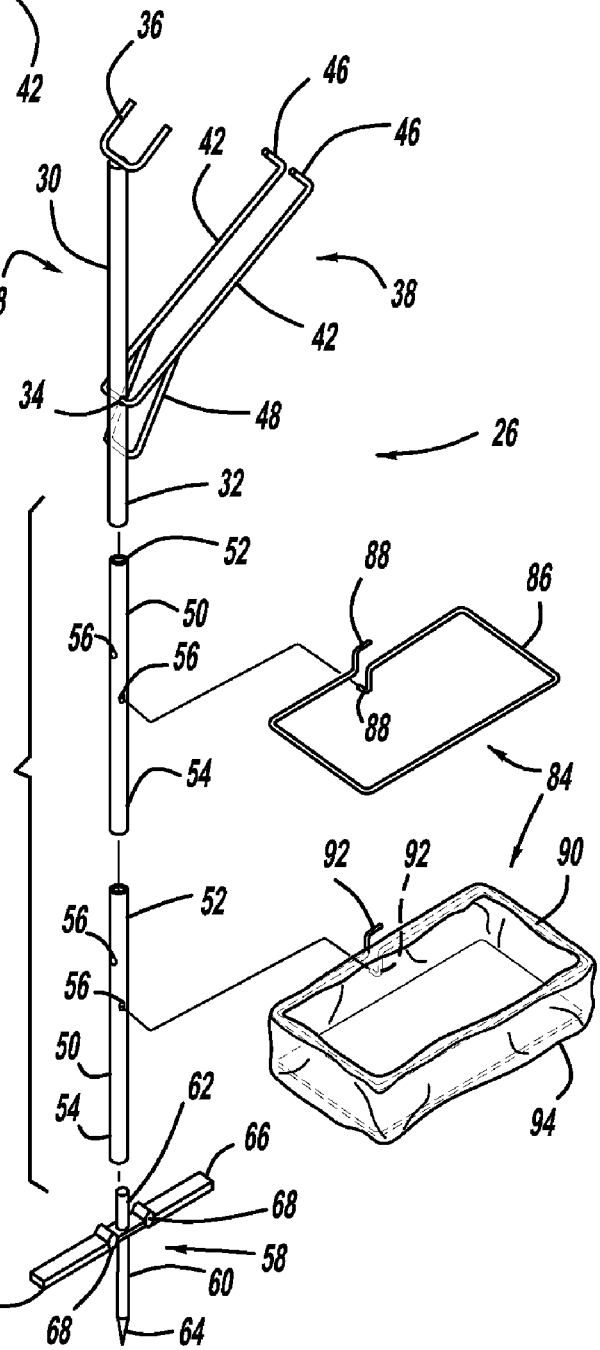
FIG. 8 is an exploded perspective view of the improved bow holder of FIG. 3.

The preferred embodiment of an improved bow holder 26 is shown in FIG. 8. The bow holder 26 is intended to securely hold a bow 20 such that the bow is not contaminated by water, mud or other debris on the ground and such that the bow 20 may be quickly retrieved for use. A typical compound bow 20 is shown in FIG. 1. The bow 20 is comprised of a pair of limbs 22, two cams 24 and a bow string. A cam 24 is located at the distal end of each limb 22. The bow string is attached to the cams 24 such that a pulling force exerted on the bow string causes the limbs 22 to bend. The bow holder 26 should be configured to securely receive a cam 24 of a bow 20.

The lower limb 22 of the bow 20 is held by a bow cradle 28. The bow cradle can be attached to a base 58, an extension member 50 or a tree mount 70. The bow cradle 28 is comprised of a body 30, a guide 36 and a limb rest 38. Preferably, the body 30 is fabricated from a malleable metallic pipe. The lower end of the body 30 has a first mating end 32. The first mating end 32 is shaped and sized to mate with a member having a second mating end. The terms first mating end and second mating end are used to distinguish two types of mating end configurations wherein the first mating end is adapted to attach to a second mating end. Preferably, the first mating end 32 of the body 30 is a circular opening at the lower end of the body 30 which is slightly larger than the outside diameter of a second mating end 52, 62 82 of an extension member 50, the stem 60 of a base 58 or the mating member 80 of a tree mount 70, respectively. The depth of the mated fit between the first mating end 32 of the body 30 and the second mating end of the member having a second mating end to which the body 30 is attached is controlled by reducing the inside diameter of the body 30 so that penetration is limited to a desired depth.

Figure 4:
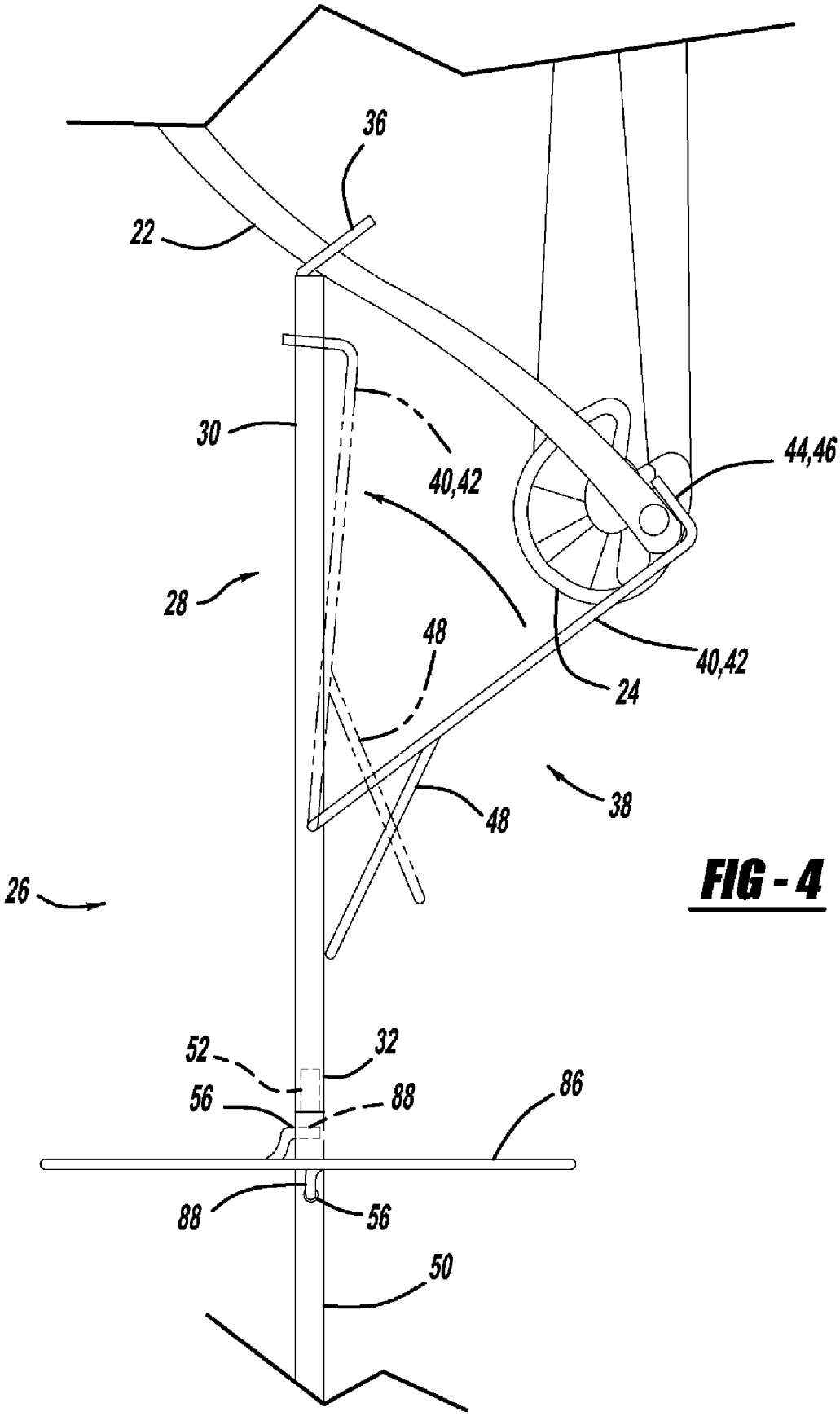
FIG. 4 is a broken away side elevation view of the improved bow holder of FIG. 2 showing the pivoting action of the limb rest of the bow holder.
Figure 6:
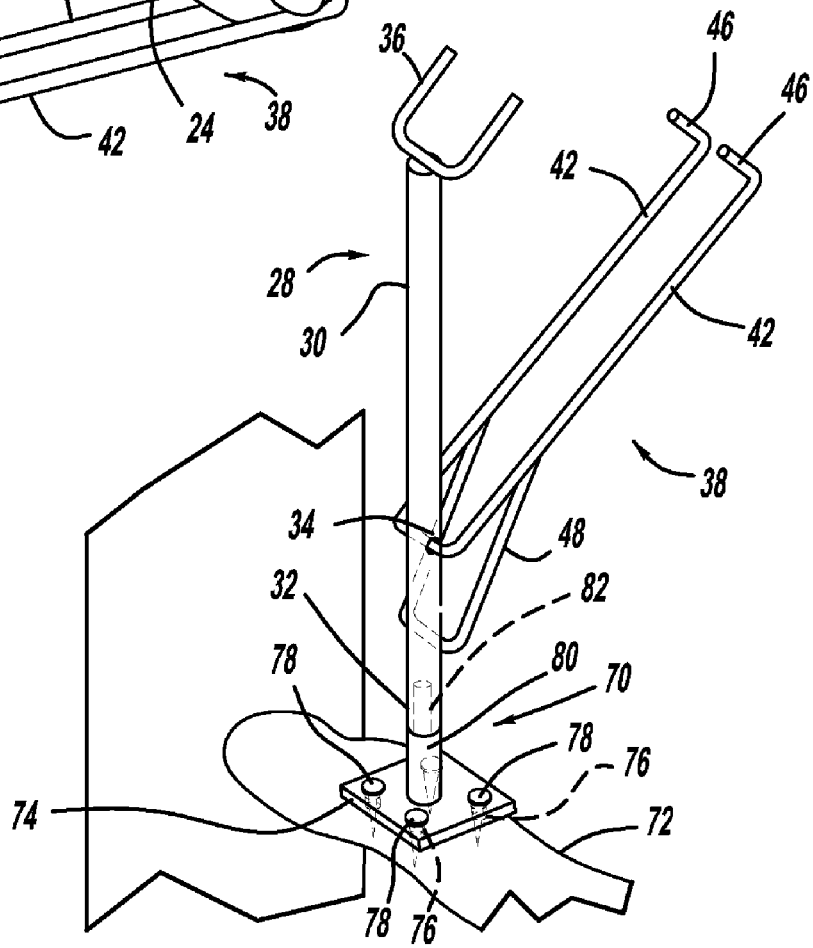
FIG. 6 is a perspective view of the bow cradle of FIG. 5, without the bow, mounted to a tree.
Figure 7:
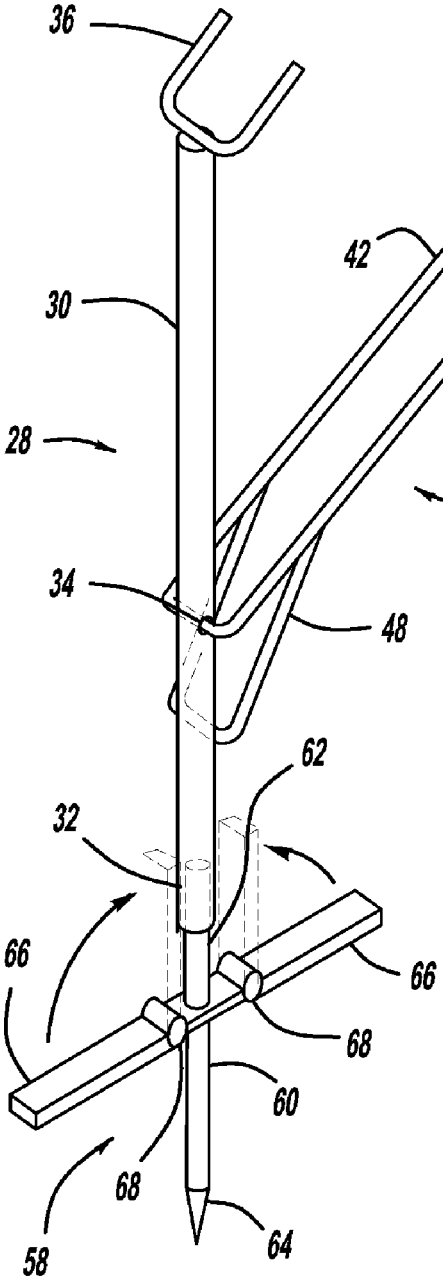
FIG. 7 is a perspective view of the bow cradle of FIG. 5, without the bow, mounted to a base.

FIG. 4 shows the first mating end 32 of the body 30 press fit over the second mating end 52 of an extension member 50. FIG. 7 shows the first mating end 32 of the body 30 press fit over the second mating end 62 of the stem 60 of a base 58. FIG. 6 shows the first mating end 32 of the body 30 press fit over the second mating end 82 of a mating member 80 of a tree mount 70. All three of these figures show the bottom of a pipe shaped body 30 fit over another pipe shaped member. Other types of first mating ends and matching second mating ends may also be used. For example, the outside portion of the bottom of the body 30 may fit inside of a pipe shaped member having an inside diameter slightly larger than the outside diameter of the end of the body 30. The mating members may be screwed together. The mating members may have mating ends which are keyed to lock with each other. If the mating members have a square or rectangular cross-section it will be easier to position quiver frame holes 56 located on extension members 50 in their proper location relative to the limb rest 38 and the base 58.

Figure 2:
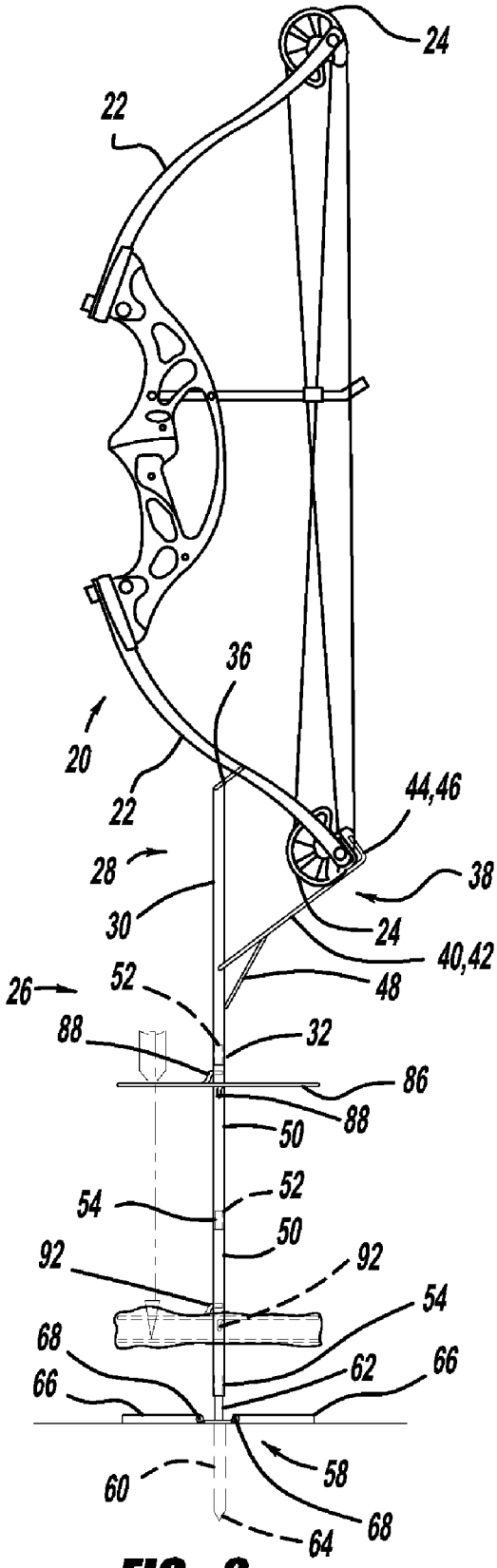
FIG. 2 is a side elevation view of the improved bow holder of FIG. 1 after placement of a bow within the bow holder.
Figure 3:
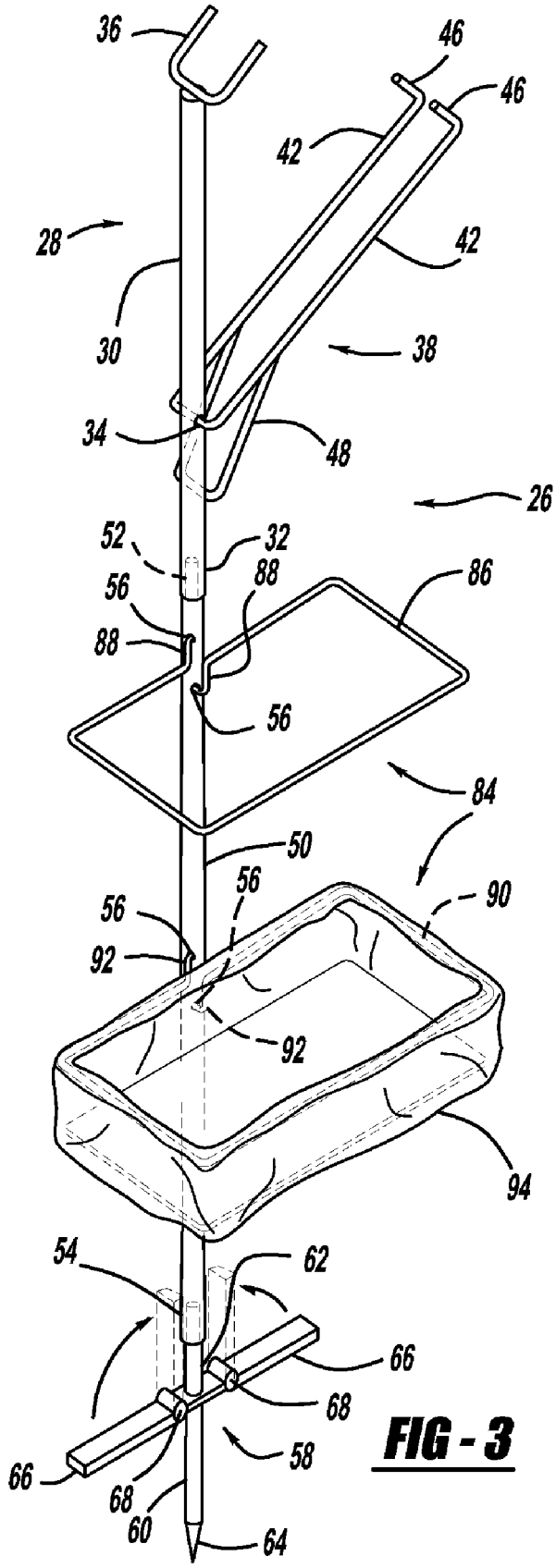
FIG. 3 is a perspective view of an improved bow holder.

The guide 36 is shaped and sized to receive and securely hold a limb 22 of the bow 20. Preferably, the guide 36 is a U-shaped bracket fabricated from malleable metal rod. The inside width of the U-shaped bracket is slightly larger than the width of the lower limb 22 of the bow 20 intended to be supported. The guide 36 is attached to an upper aspect of the body 30. The plane of the guide 36 formed by the three branches of the U-shaped bracket should form an acute angle with the circular cross-section of the body 30, as shown in FIG. 2. This will facilitate securely holding of the bow 20. The guide 36 should be welded to the body 30. In order to provide a flat surface on the upper end of the body 30 for mounting the guide 36, the upper end of the body 30 should be flattened. The flattened portion can also be bent away from the longitudinal axis of the body 30 to facilitate different mounting angles for the guide 36.

Figure 5:
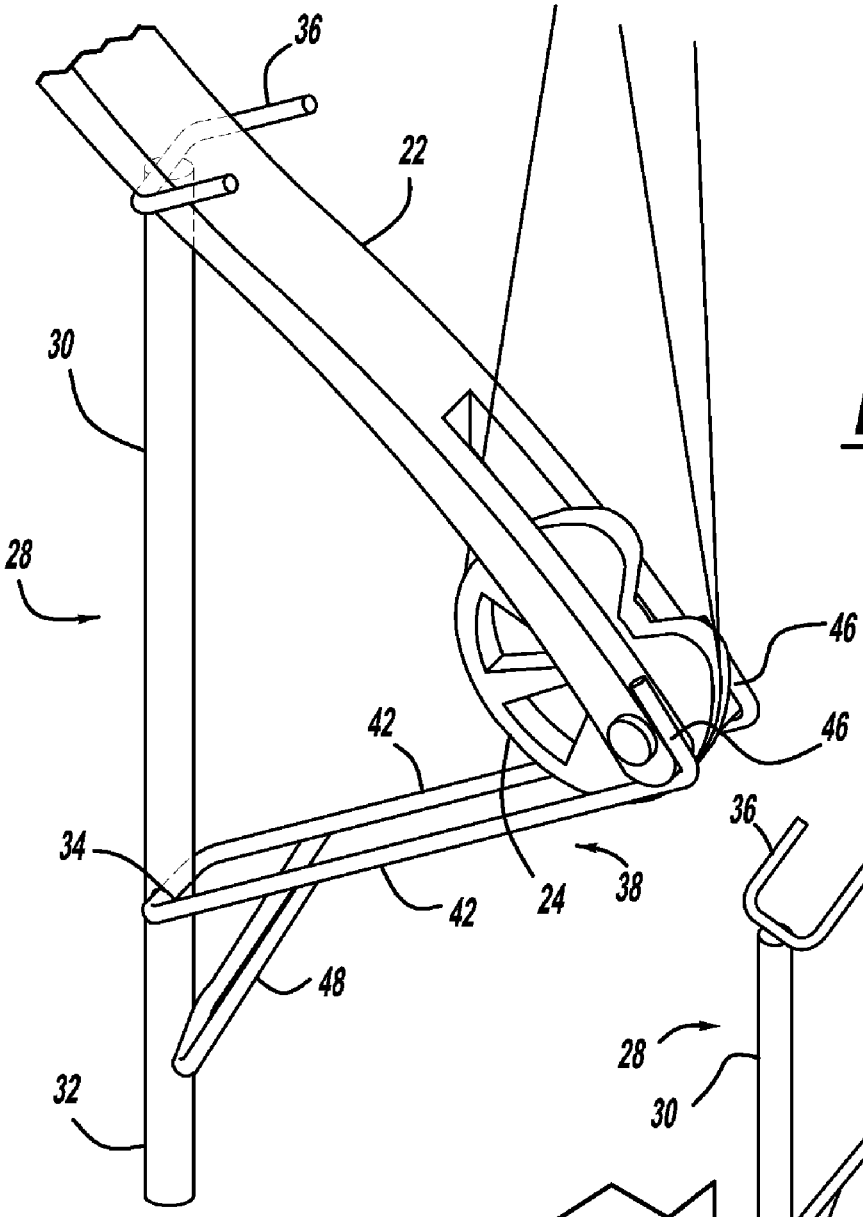
FIG. 5 is a perspective view of the bow cradle of the improved bow holder of FIG. 2.

The limb rest 38 is comprised of a pair of extension arms 42, a pair of upright arms 46 and a stop 48. The extension arms 42, the upright arms 46 and the stop 48 may be fabricated from malleable metal rod. The extension arms 42 form a bed 40 for supporting the limb 22 of the bow 20. The extension arms 42 are spaced apart such that they may simultaneously support the limb 22, as shown in FIG. 5. The extension arms 42 are adapted to be pivotally mounted to the body 30. This is accomplished by positioning a pair of holes 34 within the body 30 for receiving the extension arms 42, as shown in FIGS. 3, 5, 6, 7 and 8. Those figures depict a pair of extension arms 42 formed from a single piece of malleable metal rod. The rod is inserted through the holes 34 within the body 30 and then bent to form the pair of extension arms 42. Thus, the extension arms 42 are pivotally attached to the body 30.

An upright arm 46 projects substantially perpendicularly from the end of each extension arm 42 distal to the body 30. The upright arms 46 are spaced apart such that a cam 24 of the bow 20 may pass through a plane defined by the upright arms 46, and such that the limb 22 of the bow 20 may not pass through a plane defined by the upright arms 46 when the limb 22 of the bow is seated upon the extension arms 42, as shown in FIG. 5. The upright arms 46 form a wall 44 which prevents the limb 22 of the bow 20 from sliding along the extension arms 42 and away from the body 30. Thus, the wall 44 formed by the upright arms 46 prevents the bow 20 from falling off of the extension arms 42.

The stop 48 is attached to a lower aspect of the extension arms proximal to the body 30, as shown in FIG. 5. The stop 48 may be fabricated by bending a malleable metal rod into a U-shaped configuration and welding it to the extension arms 42, as shown in FIG. 5. The stop 48 is attached to the extension arms 42 such that the angle defined by the extension arms 42 and the upper aspect side of the body 30 is an acute angle when the stop 48 contacts the body, as shown in FIG. 4.

The improved bow holder 26 may have one or more extension members 50 between the bow cradle 28 and the base 58. The bow cradle 28 may be attached directly to the second mating end 62 of the stem 60 of a base 58, or it may be attached directly to the second mating end 82 of the mating member 80 of a tree mount 70. Both of these configurations provide a low bow holding position. The extension members 50 are used to raise the bow holding position by raising the position of the limb rest 38. Each extension member 50 has a second mating end 52 at its upper end. The second mating end 52 is shaped and sized to mate with a member having a first mating end 32, 54, as previously described. Each extension member 50 has a first mating end 54 at its lower end. The first mating end 54 is shaped and sized to mate with a member having a second mating end 52, 82, as previously described. The extension members 50 may be fabricated from malleable metallic pipe. Preferably, the mating ends 52, 54 of the extension members 50 consist of inside and outside pipe diameters which fit together, as previously described.

The base 58 is comprised of a stem 60 and a pair of pedals 66. Preferably, the stem 60 is fabricated from a metal rod having a pointed end 64 at its lower end. The pointed end 64 is inserted into the ground during use. The upper end of the stem 60 has a second mating end 62. The second mating end 62 is shaped and sized to mate with a member having a first mating end 32, 54, as previously described. Preferably, the second mating end 62 is fabricated from malleable metallic pipe. The second mating end 62 should be configured so that it may be press fit into the first mating end 32 of the body 30, or, the first mating end 54 of an extension member 50. However, other mating combinations may be used, as previously described.

The pedals 66 are hingedly attached to the stem 60, as shown in FIG. 7 and FIG. 8. The pedals 66 fold between an upright position, as shown by the phantom pedals 66 in FIG. 7 and a horizontal position as shown by the non-phantom pedals 66 in FIG. 7. Because the pedals 66 are physically limited from going below the horizontal plane, they may be used to apply a ground insertion force to the stem 60 by the user stepping on one or both pedals 66. The pedals 66 may be fabricated from steel. Preferably, the pedals 66 are fabricated into rectangular forms, as shown in FIG. 7. A hinge 68 is used to connect each pedal 66 to the stem 60.

Each pedal 66 may be hingedly attached to the stem 60 in the following manner. Two nuts are attached to one of the shorter peripheral edges of the pedal 66. A nut is attached to the stem 60. The nuts are aligned such that a threaded bolt may be inserted through each nut and such that the longitudinal axis of the threaded bolt forms a hinge axis for the pedal 66. The nuts are secured to each other by inserting a threaded bolt through each nut. The threaded bolt is fixed to the two nuts attached to the pedal 66, but allowed to rotate within the nut attached to the stem 60, thereby forming a pedal hingedly attached to the stem 60.

If one or more extension members 50 are used to raise the bow holding position, the lower end of one extension member 50 is attached to the upper end of the stem 60. Preferably, the lower end of another extension member 50 is attached to the upper end of the extension member 50 which is attached to the stem 60. When one or more extension members 50 are used the body 30 of the bow cradle 28 is attached to the second mating end 52 of the uppermost extension member 50. Otherwise, if a base 58 without extension members 50 is used, the lower end of the body 30 of the bow cradle 28 is attached to the second mating end 62 of the stem 60. If a tree mount 70 is used without extension members 50, the lower end of the body 30 of the bow cradle 28 is attached to the second mating end 82 of the mating member 80 of the tree mount 70. Extension members 50 may also be used between a tree mount 70 and a bow cradle 28.

A quiver 84 may be attached to one or more extension members 50, as shown in FIG. 8. The quiver 84 permits arrows to be held in close proximity to a bow 20 supported by the improved bow holder 26. Preferably, the quiver 84 is releasably attached to at least one extension member 50. This will allow the quiver 84 to be attached and detached quickly and easily. The preferred quiver 84 is comprised of an upper frame 86, a lower frame 90 and a cloth basket 94. The upper frame 86 should be fabricated from malleable metal rod. It should be formed as a rectangle with two mounting prongs 88. The mounting prongs 88 of the upper frame 86 are adapted to fit within quiver frame mounting holes 56 within an extension member 50. The lower frame 90 should also be fabricated from malleable metal rod. It should also be formed as a rectangle with two mounting prongs 92. The mounting prongs 92 of the lower frame 90 are adapted to fit within quiver frame mounting holes 56 within an extension member 50. Preferably, the upper frame 86 mounting holes 56 are within an upper extension member 50 and the lower frame 90 mounting holes 56 are within a lower extension member 50. A cloth basket 94 is attached to the lower frame 90. The upper frame 86, the lower frame 90 and the cloth basket 94 form a container for holding arrows. The lower frame 90 and the upper frame 86 should be spaced apart such that the quiver 84 may securely hold a plurality of arrows.

The bow cradle 28 may be used with a tree mount 70 in a tree on a tree stand structure, as previously defined. The tree mount 70 mounts to a tree stand structure such as a tree limb 72, or the surface of a constructed tree stand, and is attachable to the bow cradle 28. A tree mount 70 is comprised of a flange 74 and a mating member 80. The flange 74 is adapted to be seated upon a tree stand structure including a tree limb 72. The flange 74 has a plurality of fastener openings 76. The fastener openings 76 are adapted to secure the flange 74 upon a surface of the tree stand structure with fasteners 78, such as nails or screws. The fastener openings 76 may consist of a plurality of openings adapted to receive nails or screws, as shown in FIG. 6. Preferably, the flange 74 has four fastener openings 76. The fastener openings 76 may be nail holes or screw holes. The fastener openings 76 may also be slots opening into the external periphery of the flange 74. The size of the fastener openings 76 should be sufficiently large to permit fastener stems to pass through, yet be sufficiently small to prevent fastener heads from passing through.

The components of the preferred embodiment of the improved bow holder 26 should have approximately the following dimensions and material specifications. However, it must be emphasized that this invention is not limited to these dimensions and materials and other embodiments of the invention may have significantly different dimensions and materials. The extension arms 42, the stop 48, the upright arms 46 and the guide 36 may be fabricated from ¼" steel rod. The preferred extension arm 42 length is 5¼". The preferred upright arm 46 length is 1¼". The preferred guide 36 opening is 2 inches with 1 inch branches on the U-shaped structure. The preferred angle between the guide 36 and a horizontal plane coinciding with the cross-section of the body 30 is 30°. The preferred distance between the guide 36 and the extension arms 42 is 7 inches. The preferred inside diameter of the first mating end 32 of the body 30 is 9/16". ⅝" outside diameter pipe may be used for the body 30. The second of mating ends 52, 62, 82 of the extension member 50, the stem 60 of the base 58 and the mating member 80 of the tree mount 70 should have outside diameters of 17/32". The preferred length of the extension members 50 is 10½". The preferred penetration depth of second mating ends 52, 62 82 into first mating ends 32, 54 is ⅝". The preferred distance between the upper frame 86 of the quiver 84 and the lower frame 90 of the quiver 84 is 14 inches. The preferred angle between the extension arms 42 and the upper aspect of the body 30 when the stop 48 contacts the body 30 is 55°.

In order to use the improved bow holder 26 in a standing position, the bow cradle 28, two extension members 50 and the base 58 are assembled together, as shown in FIG. 8. Optionally, a quiver 84 may be attached to the extension members 50. The pedals 66 of the base are unfolded and foot pressure is used to insert the stem 60 into the ground. A first extension member 50 is attached to the second mating end 62 of the stem 60. In the preferred embodiment the second mating end 62 of the stem 60 is inserted into the first mating end 54 of the first extension member 50 and held together by a press fit. Similarly, the second extension member 50 is attached to the first extension member 50. In the preferred embodiment, the second mating end of the first extension member 50 is inserted into the first mating end 54 of the second extension member 50 and held together by a press fit. The bow cradle 28 is attached to the second extension member 50. In the preferred embodiment, the second mating end of the second extension member 50 is inserted into the first mating end 32 of the body 30 of the bow cradle 28 and held together by a press fit. The limb rest 38 is unfolded such that the stop 48 contacts the body 30. The lower limb 22 of the bow 20 is placed within the guide 36 and seated upon the extension arms 42 of the limb rest 38 so that the cam 24 attached to the limb 22 protrudes through the space between the upright arms, as shown in FIG. 5.

A hunter may assemble the improved bow holder 26 and insert it into the ground of a hunting field. After a bow 20 is placed within the bow cradle 28, the hunter may easily stand behind the supported bow 20 and await the arrival of a hunted animal. Once the hunted animal arrives the hunter may grasp the bow 20 with very little physical movement and prepare to shoot an arrow. The ability to grasp the bow 20 and shoot an arrow with very little physical movement by the hunter provides a hunting advantage because the hunted animal is much less likely to notice the hunter and quickly flee. Arrows may be conveniently stored within the quiver 84.

If the hunter desires to hunt from a lower position the bow cradle 28 may be used with only one extension member 50. If the hunter desires to ground hunt from a seated position, the bow cradle 28 may be attached directly to the base 58. If the hunter desires to hunt from a tree, a tree mount 70 is attached to a tree stand structure by nailing or screwing the tree mount flange 74 to the structure, which may be a tree limb 72. The bow cradle 28 is then attached to the second mating end 82 of the mating member 80 of the flange 74. The bow cradle 28 position may be raised by using one or more extension members 50. A quiver 84 may also be attached to the extension members 50 when the improved bow holder 26 is used within a tree or a tree stand structure.

The improved bow holder 26 may also be used in a target shooting setting. There, an archer intends to shoot arrows at a target, rather than at hunted animals. The same procedure described above is used to configure the bow cradle 28 to support the archer's bow 20 in a low, intermediate or high position.

After the hunter is done hunting or the archer is done target shooting the improved bow holder 26 components may be quickly and easily disassembled. The bow cradle 28 is removed from the extension member 50, the base 58 or the tree mount 72 to which it is attached by pulling the components apart. If a quiver 84 is used, the upper frame 86 and the lower frame 90 are removed. The limb rest 38 is folded such that it is substantially parallel to the body 30 of the bow cradle. Any extension members 50 used are separated from the components to which they are attached by pulling them apart. The base 58 is removed from the ground by pulling it out. The pedals 66 of the base 58 are folded such that they are substantially parallel to the stem 60. If a tree mount 70 is used it may be left in the tree or the tree stand structure for later use, or it may be removed. The disassembled components should be stored in a small pouch. The pouch may be attached to the user's belt. In this way the components of the improved bow holder 26 may be easily carried by a user.

The improved bow holder 26 has many advantages. It can be mounted on the ground or upon a tree stand structure. It holds and keeps a bow 20 elevated above the ground or a tree stand structure, such as a tree limb 72, upon which it is mounted. Its height is adjustable so that an archer can use the bow holder 26 while sitting, standing or squatting (or sitting at a higher level). It is easy to store. It is lightweight and takes up minimal space. It can be quickly assembled. It may also be equipped with a quiver 84 for holding arrows.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A bow cradle for supporting a bow, said bow cradle comprising:

a body having at its lower end a first mating end shaped and sized to mate with a member having a second mating end;

a guide shaped and sized to receive and securely hold a limb of the bow, said guide being attached to an upper aspect of the body;

a limb rest comprising:

a bed adapted to support the limb of the bow;

said bed being pivotally attached to the body;

a wall projecting substantially perpendicularly from the end of the bed distal to the body; and a stop attached to a lower aspect of the bed proximal to the body such that the angle defined by the bed and the upper aspect side of the body is an acute angle when the stop contacts the body.

2. The bow cradle for supporting a bow of claim 1, further comprising:

a stem, having a lower end which is pointed for insertion into a ground surface and an upper end having a second mating end shaped and sized to mate with a member having a first mating end;

wherein the lower end of the body is attached to the upper end of the stem such that the first mating end of the body on the lower end of the body mates with the second mating end on the upper end of the stem.

3. The bow cradle for supporting a bow of claim 1, further comprising:

a tree mount comprising:

a flange adapted to be seated upon a tree stand structure, said flange having a plurality of fastener openings for securing the flange to the tree stand structure with fasteners; and a mating member perpendicularly attached to the flange, the distal end of said mating member having a second mating end shaped and sized to mate with a member having a first mating end;

wherein the lower end of the body is attached to the distal end of the mating member such that the first mating end of the body on the lower end of the body mates with the second mating end on the distal end of the mating member.

4. The bow cradle for supporting a bow of claim 1, wherein the wall is shaped and sized such that a cam of a bow may pass through a plane defined by the wall and such that a limb of a bow may not pass through a plane defined by the wall when the limb of the bow is seated upon the bed.

5. The bow cradle for supporting a bow of claim 2, wherein the wall is shaped and sized such that a cam of a bow may pass through a plane defined by the wall and such that a limb of a bow may not pass through a plane defined by the wall when the limb of the bow is seated upon the bed.

6. The bow cradle for supporting a bow of claim 3, wherein the wall is shaped and sized such that a cam of a bow may pass through a plane defined by the wall and such that a limb of a bow may not pass through a plane defined by the wall when the limb of the bow is seated upon the bed.

7. A bow cradle for supporting a bow, said bow cradle comprising:

a body having at its lower end a first mating end shaped and sized to mate with a member having a second mating end;

a guide shaped and sized to receive and securely hold a limb of a bow, said guide being attached to an upper aspect of the body;

a limb rest comprising:

a pair of extension arms for supporting a limb of a bow, said extension arms being spaced apart such that they may simultaneously support the limb;

said extension arms being pivotally attached to the body;

an upright arm projecting substantially perpendicularly from the end of each extension arm distal to the body, said upright arms being spaced apart such that a cam of a bow may pass through a plane defined by the upright arms and such that a limb of a bow may not pass through a plane defined by the upright arms when the limb of a bow is seated upon the extension arms; and a stop attached to a lower aspect of the extension arms proximal to the body such that the angle defined by the extension arms and the upper aspect side of the body is an acute angle when the stop contacts the body.

8. The bow cradle for supporting a bow of claim 7, further comprising:

a base comprising:

a stem, having a lower end which is pointed for insertion into a ground surface and an upper end having a second mating end shaped and sized to mate with a member having a first mating end; and a pair of pedals hingedly attached to the upper end of the stem for allowing ground insertion force to be applied to the stem;

wherein the lower end of the body is attached to the upper end of the stem such that the first mating end of the body on the lower end of the body mates with the second mating end on the upper end of the stem.

9. The bow cradle for supporting a bow of claim 7, further comprising:

a tree mount comprising:

a flange adapted to be seated upon a tree stand structure, said flange having a plurality of fastener openings for securing the flange to the tree stand structure with fasteners; and a mating member perpendicularly attached to the flange, the distal end of said mating member having a second mating end shaped and sized to mate with a member having a first mating end;

wherein the lower end of the body is attached to the distal end of the mating member such that the first mating end of the body on the lower end of the body mates with the second mating end on the distal end of the mating member.

10. An improved bow holder for supporting a bow, said bow holder comprising:

a bow cradle comprising:

a body having at its lower end a first mating end shaped and sized to mate with a member having a second mating end;

a guide shaped and sized to receive and securely hold a limb of the bow, said guide being attached to an upper aspect of the body;

a limb rest comprising:

a pair of extension arms for supporting the limb of the bow, said extension arms being spaced apart such that they may simultaneously support the limb;

said extension arms being pivotally attached to the body;

an upright arm projecting substantially perpendicularly from the end of each extension arm distal to the body, said upright arms being spaced apart such that a cam of the bow may pass through a plane defined by the upright arms and such that the limb of the bow may not pass through a plane defined by the upright arms when the limb of the bow is seated upon the extension arms; and a stop attached to a lower aspect of the extension arms proximal to the body such that the angle defined by the extension arms and the upper aspect side of the body is an acute angle when the stop contacts the body;

at least one extension member, each said extension member having at its upper end a second mating end shaped and sized to mate with a member having a first mating end and at its lower end a first mating end shaped and sized to mate with a member having a second mating end;

a base comprising:

a stem, having a lower end which is pointed for insertion into a ground surface and an upper end having a second mating end shaped and sized to mate with a member having a first mating end; and a pair of pedals hingedly attached to the upper end of the stem for allowing ground insertion force to be applied to the stem;

wherein the lower end of one extension member is attached to the upper end of the stem;

wherein the lower end of the body of the bow cradle is attached to a second mating end of an extension member; and wherein the guide, the limb rest, the body, the at least one extension member and the base are oriented such that the longitudinal axis of the bow string of a bow secured by the bow holder is perpendicular to the plane of the ground when the stem is vertically inserted into the ground.

11. The improved bow holder for supporting a bow of claim 10, further comprising a quiver attached to the at least one extension member.

12. The improved bow holder for supporting a bow of claim 11, wherein the quiver is releasably attached to the at least one extension member.

* * * * *